US011021873B2

(12) United States Patent
Banta et al.

(10) Patent No.: US 11,021,873 B2
(45) Date of Patent: Jun. 1, 2021

(54) MOVABLE PARTITION SYSTEMS AND RELATED METHODS

(71) Applicant: Won-Door Corporation, Salt Lake City, UT (US)

(72) Inventors: Kevin D. Banta, Orem, UT (US); Matt Spear, Orem, UT (US); Ivan W. Stewart, Herriman, UT (US); William Michael Coleman, Salt Lake City, UT (US); R. Scott Smart, Draper, UT (US); Michael D. George, Kaysville, UT (US); Paul Saccomanno, West Valley City, UT (US)

(73) Assignee: Won-Door Corporation, Salt Lake City, UT (US)

( * ) Notice: Subject to any disclaimer, the term of this patent is extended or adjusted under 35 U.S.C. 154(b) by 165 days.

(21) Appl. No.: 16/409,628

(22) Filed: May 10, 2019

(65) Prior Publication Data

US 2020/0354953 A1 Nov. 12, 2020

(51) Int. Cl.
*E04B 2/82* (2006.01)
*E06B 3/46* (2006.01)
*E04B 2/74* (2006.01)

(52) U.S. Cl.
CPC ..... *E04B 2/827* (2013.01); *E06B 3/4654* (2013.01); *E04B 2/7403* (2013.01)

(58) Field of Classification Search
CPC ..... E04B 2/7403; E04B 2/827; E06B 3/94; E06B 3/481; E06B 3/4654; E06B 7/16; E06B 5/164
See application file for complete search history.

(56) References Cited

U.S. PATENT DOCUMENTS 6,662,848 B2 * 12/2003 Goodman ..... E05D 15/26 160/84.02
7,066,297 B2 * 6/2006 Goodman ..... E05D 15/26 160/84.02
7,845,384 B2 * 12/2010 Goodman ..... E05B 65/0085 160/118
8,443,866 B2 5/2013 Goodman
8,448,687 B2 * 5/2013 Saccomanno ..... E06B 3/94 160/84.02
8,567,472 B2 * 10/2013 Stewart ..... E05F 15/635 160/84.08
8,627,618 B2 * 1/2014 Knight ..... E05B 65/0085 52/213

(Continued)

*Primary Examiner* — Brent W Herring
(74) *Attorney, Agent, or Firm* — TraskBritt

(57) ABSTRACT

A movable partition system includes a movable partition, a floating jamb attached to an end of the movable partition and located within a pocket configured to retain the movable partition when in a retracted position, at least two base plates attached to the floating jamb, and at least two jamb stops attached to opposing interior walls of the pocket. Each of the at least two jamb stops are configured to engage a respective base plate of the floating jamb, wherein the floating jamb, the at least two base plates, and the at least two jamb stops are configured such that disengaging the floating jamb from a secure position within the pocket when the movable partition is in an extended position requires disengaging one of the at least two jamb stops from the respective base plate on each side of the movable partition. Methods of providing a security barrier are disclosed.

20 Claims, 7 Drawing Sheets

(56) References Cited

U.S. PATENT DOCUMENTS 8,641,105 B2 * 2/2014 Goodman ..... E05B 1/0046 292/251.5
8,701,739 B2 * 4/2014 Coleman ..... E05D 15/26 160/199
8,863,814 B2 * 10/2014 Smart ..... E06B 9/0669 160/199
8,967,225 B2 * 3/2015 Coleman ..... E06B 1/60 160/199
9,309,710 B2 * 4/2016 Goodman ..... E05D 15/0626
9,470,024 B2 * 10/2016 Knight ..... E05C 19/024
10,017,974 B2 * 7/2018 Coleman ..... E06B 1/60
10,253,546 B2 * 4/2019 Goodman ..... E05D 15/0652
10,711,511 B2 * 7/2020 Coleman ..... E05D 15/26
2003/0155081 A1 * 8/2003 Goodman ..... E05F 15/40 160/84.02
2004/0094275 A1 * 5/2004 Goodman ..... E05F 15/72 160/188
2009/0044918 A1 * 2/2009 Goodman ..... E06B 3/94 160/202
2011/0000625 A1 * 1/2011 George ..... E06B 3/94 160/84.02
2012/0042573 A1 * 2/2012 Knight ..... E05B 65/104 49/449
2012/0187703 A1 * 7/2012 Goodman ..... E05C 19/16 292/251.5
2012/0199295 A1 * 8/2012 Smart ..... E06B 9/0669 160/127
2012/0227914 A1 * 9/2012 Coleman ..... E05F 15/605 160/188
2013/0020033 A1 * 1/2013 Saccomanno ..... E06B 3/94 160/84.04
2013/0020036 A1 * 1/2013 Stewart ..... E05F 15/635 160/188
2013/0081333 A1 * 4/2013 Stewart ..... E05B 15/0205 49/404
2013/0240160 A1 * 9/2013 Coleman ..... E05D 15/26 160/223
2014/0116633 A1 * 5/2014 Knight ..... E05D 15/12 160/405
2014/0224433 A1 * 8/2014 Goodman ..... E05D 15/0643 160/127
2015/0167371 A1 * 6/2015 Coleman ..... E06B 3/4654 52/741.1
2016/0177613 A1 * 6/2016 Goodman ..... E05D 15/0652 160/7
2018/0100344 A1 * 4/2018 Knight ..... E06B 3/94
2018/0291672 A1 * 10/2018 Coleman ..... E06B 3/481

* cited by examiner

MOVABLE PARTITION SYSTEMS AND RELATED METHODS

TECHNICAL FIELD

Embodiments of the disclosure relate generally to movable partition systems configured to subdivide a space utilizing a folding partition. More specifically, disclosed embodiments relate to movable partition systems including floating jambs secured within a pocket when the movable partitions are in an extended position, and related methods.

BACKGROUND

Movable partitions are utilized in numerous situations and environments for a variety of purposes. Such partitions may include, for example, a foldable or collapsible door configured to enclose or subdivide a room or other area. Often, such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event, such as the actuation of an associated alarm. For example, one or more accordion or similar folding-type partitions may be used as a security barrier, a fire barrier, or both a security barrier and a fire barrier wherein each partition is formed with a plurality of panels connected to one another, with hinges in some cases. The hinged connection of the panels allows the partition to fold and collapse into a compact unit for purposes of storage when not deployed. The partition may be stored within a pocket formed in the wall of a building when in a retracted or folded state. When the partition is deployed to subdivide or separate a space within a building, so as to secure an area during a fire or for any other specified reason, the partition may be extended along an overhead track, which is often located above the movable partition in a header assembly, until the partition extends a desired distance across the room.

When deployed, a leading end of the movable partition, often defined by a component known as a lead post, complementarily engages another structure, such as a wall, a post, or a lead post of another door. A trailing end of the movable partition may include a fixed jamb or, alternatively, a floating jamb configured to slide within the pocket accommodating the movable partition when in a retracted position. Jamb stops may be provided to retain the floating jamb within the pocket when the movable partition is in the extended position.

BRIEF SUMMARY

In one embodiment of the disclosure, a movable partition system may include a movable partition, a floating jamb attached to an end of the movable partition and located within a pocket configured to retain the movable partition when in a retracted position, at least two base plates attached to the floating jamb, and at least two jamb stops attached to opposing interior walls of the pocket. Each of the at least two jamb stops are configured to engage a respective base plate of the floating jamb, wherein the floating jamb, the at least two base plates, and the at least two jamb stops are configured such that disengaging the floating jamb from a secure position within the pocket when the movable partition is in an extended position requires disengaging one of the at least two jamb stops from the respective base plate on each side of the movable partition.

In another embodiment of the disclosure, a movable partition system includes a movable partition having a distal end and a proximal end, a lead post attached to the distal end of the movable partition, and a floating jamb attached to the proximal end of the movable partition. The floating jamb is configured to glide within a pocket during extension and retraction of the movable partition. The movable partition system also includes a security assembly including at least two opposing base plates attached to the floating jamb, each of the at least two opposing base plates comprising a base portion and a lip, and at least two opposing jamb stops attached to sidewalls of the pocket, each of the at least two opposing jamb stops comprising a hinged portion including a lip. The lip of the hinged portion of the at least two opposing jamb stops is configured to engage the lip of a respective base plate when the movable partition is in an extended position. The floating jamb, the at least two opposing base plates, and the at least two opposing jamb stops are configured such that displacement of the floating jamb is prevented when accessed through only one side of the movable partition when the movable partition is in the extended position.

In a further embodiment of the disclosure, a method of providing a security barrier includes extending a movable partition along at least one track with which the movable partition is engaged, securing a lead post attached to a distal end of the movable partition to a receptacle of a post, an opposing wall, or another lead post of another movable partition, and securing a floating jamb attached to a proximal end of the movable partition within a pocket configured to retain the movable partition when in a retracted position. Securing the floating jamb includes engaging at least one first jamb stop attached to a sidewall of the pocket with at least one first base plate attached to the floating jamb and engaging at least one second jamb stop attached to an opposing sidewall of the pocket with at least one second base plate attached to the floating jamb. The floating jamb, the at least one first base plate, the at least one second base plate, the at least one first jamb stop, and the at least one second jamb stop are configured such that releasing the floating jamb from a secure position within the pocket when the movable partition is in an extended position requires accessing the at least one first jamb stop from a first side of the movable partition to release a first side of the floating jamb and accessing the at least one second jamb stop from a second, opposing side of the movable partition to release a second, opposing side of the floating jamb.

DETAILED DESCRIPTION

Figure 1:
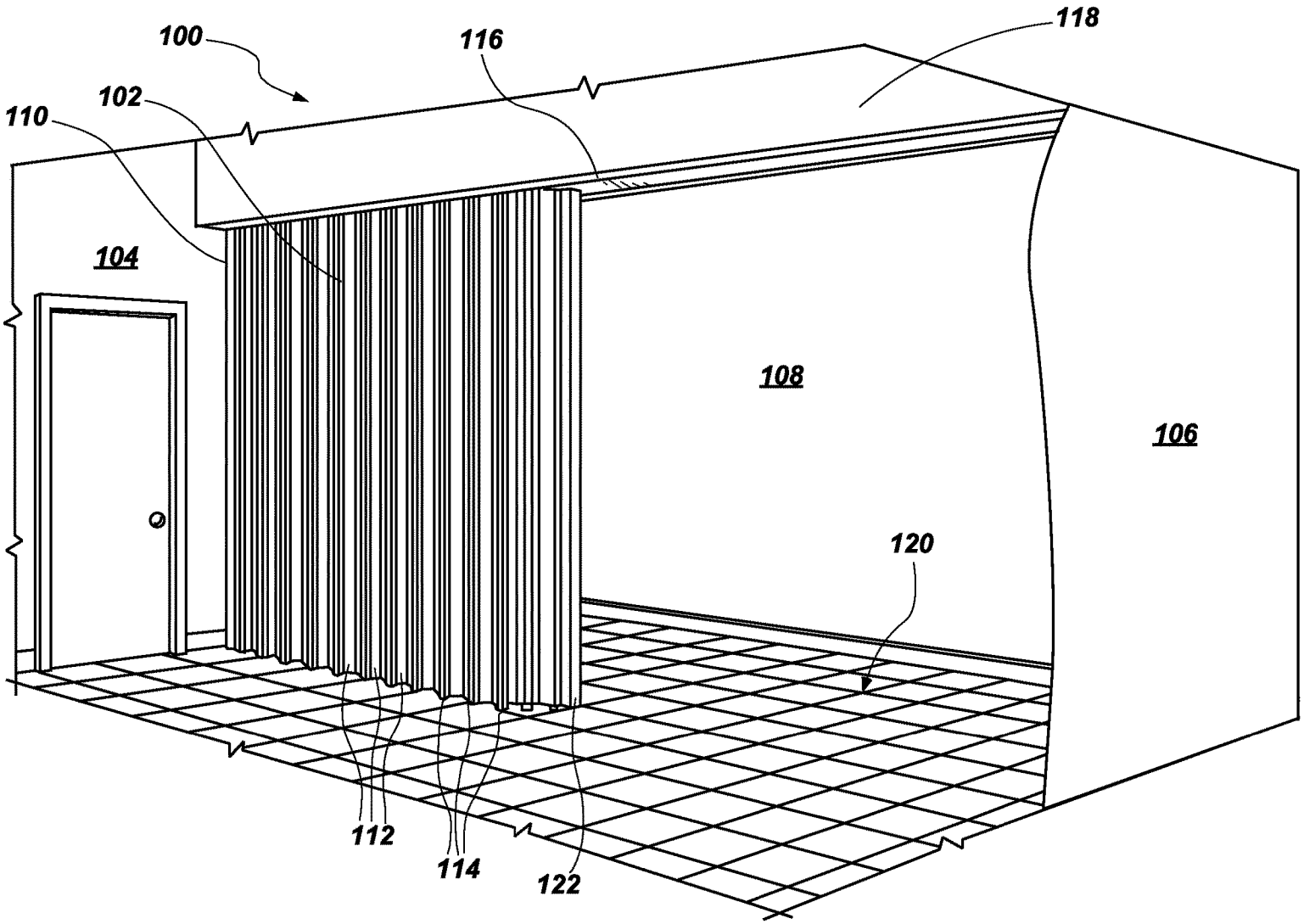
FIG. 1 is a perspective side view of a partition system.

The illustrations presented in this disclosure are not meant to be actual views of any particular movable partition system or component thereof, but are merely idealized representations employed to describe illustrative embodiments. Thus, the drawings are not necessarily to scale. Indeed, some of the features of the devices and systems shown in the drawings are enlarged compared to other features, for clarity. Additionally, elements common between figures may retain the same numerical designation.

Disclosed embodiments relate generally to movable partition systems including floating jambs secured within a pocket when the movable partitions are in an extended position. Such systems may prevent displacement of a floating jamb when the partitions have been deployed and, hence, unauthorized access through or around the partition. More specifically, disclosed are embodiments of movable partition systems including a movable partition and a floating jamb attached to an end of the movable partition and located within a pocket (e.g., a storage pocket of the movable partition system). The movable partition system may include two or more base plates attached to the floating jamb and two or more jamb stops attached to opposing interior walls of the pocket. Each of the at least two jamb stops may be configured to engage a respective base plate of the floating jamb, wherein the floating jamb, the base plates, and the jamb stops are configured such that disengaging the floating jamb from a secure position within the pocket when the movable partition is in an extended position requires disengaging one of the at least two jamb stops from the respective base plate on each side of the movable partition. Further, the jamb stops may include a spring-actuated hinged portion such that respective lips of the base plates and the jamb stops are configured to engage with one another when the movable partition is in the extended position and to automatically disengage from one another when the movable partition moves toward a retracted position. Such systems may also include, for example, installation assemblies and locking panel assemblies to enhance secure placement of the floating jamb within the pocket.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, at least 99.9% met, or even 100.0% met.

As used herein, the term "about" used in reference to a given parameter is inclusive of the stated value and has the meaning dictated by the context (e.g., it includes the degree of error associated with measurement of the given parameter).

Referring to FIG. 1, a perspective side view of a partition system 100 is shown. The partition system 100 may include, for example, a partition 102 configured to extend and retract between an extended position in which the partition 102 may extend from a first wall 104 toward a second wall 106 to subdivide a space 108 or otherwise form a barrier between the first and second walls 104 and 106, and a retracted position in which the partition 102 may be located at least partially (e.g., completely) within a pocket 110 extending from the first wall 104 away from the space 108. The partition 102 may be configured to extend and retract automatically in response to a detected environmental condition within the building (e.g., triggering of a smoke or fire alarm), in response to a user input, and/or in accordance with a predetermined time schedule. In some embodiments, the partition 102 may be configured to extend and retract manually by a user pushing or pulling the partition 102 as a default configuration, in response to a detected environmental condition (e.g., the presence of a person proximate the partition 102, particularly when a fire or security threat has also been detected), or in response to a user input.

In some embodiments, the partition system 100, including the partition 102 thereof, may act as a fire barrier to impede the progress of fire, smoke, and heat. Thus, a fire barrier may retard or resist the deleterious effects of fire, smoke, and heat for a certain period of time. A number of standardized tests that evaluate the effectiveness of fire barrier assemblies have been developed for use in the building industry. These standards are enforced, for example, in the International Building Code (IBC), and by the National Fire Protection Association (NFPA), and published by UNDERWRITERS LABORATORIES® (UL), and the American Society for Testing and Materials (ASTM), among others. Various agencies test fire barriers using these standardized tests, and assign ratings to fire barriers that indicate their effectiveness at slowing the progress of a fire. Barrier testing agencies include Intertek Testing Services, UL LLC (also known as UNDERWRITERS LABORATORIES®), Chiltern International Fire, Ltd., and Exova Warrington Certification (formerly known as Warrington Fire Research), among others. The partition system 100 may be rated according to at least a minimum rating for fire-resistant barriers in accordance with an approved testing agency. More specifically, the partition system 100 may achieve, for example, at least a 20-minute rating according to any of the testing methods disclosed in the Tenth Edition of ANSI/UL 10B-2015 document titled, "STANDARD FOR SAFETY Fire Tests of Door Assemblies."

The partition system 100 may also act as a security barrier. Such a security barrier system or assembly may prevent unauthorized access within designated areas of a building or complex, for example. The partition system 100 may be part of a larger security system that prevents access to commercial centers to secure entire buildings or designated areas within a building, such as during routine business closures. In addition, the partition system 100 may be utilized to secure buildings and/or designated areas upon detection of a security threat, such as, for example, assault by an armed aggressor at an educational institution, a medical facility, etc. In particular, the partition system 100 may be designed to prevent a breach of such a security system once deployed.

The partition 102 may include panels 112 interconnected to one another by hinges 114 enabling the interconnected panels 112 to fold in a plicated (e.g., accordion-like) manner to extend and retract the partition 102. The partition 102 may be suspended from a track 116, which may be located, for example, in a header assembly 118 or embedded within a ceiling structure of the building. The partition 102 may extend longitudinally (e.g., in an at least substantially vertical direction) from proximate the track 116 to proximate the floor 120. A lead post 122 may be located at an end of the partition 102 opposite the pocket 110 when the partition 102 is in the extended position. The lead post 122 may be configured to engage with a door striker located proximate the second wall 106 or another lead post of a mating partition extending from the second wall 106 to meet and mate with the partition 102 in the space 108. The lead post 122 may be movable laterally (e.g., in an at least substantially horizontal direction), which may cause corresponding expansion and retraction of the partition 102 by relative movement of the interconnected panels 112 about the hinges 114. Further, the lead post 122 may be configured to be securely engaged (e.g., locked) when engaged in the fully extended position. Such partition systems are described in detail, for example, in U.S. Pat. No. 6,662,848, issued Dec. 16, 2003 and titled "Automatic Door and Method of Operating Same" and in U.S. Pat. No. 8,967,225, issued Mar. 3, 2015 and titled "Leading End Assemblies for Movable Partitions and Related Methods," the disclosure of each of which is incorporated herein in its entirety by this reference.

Figure 2:
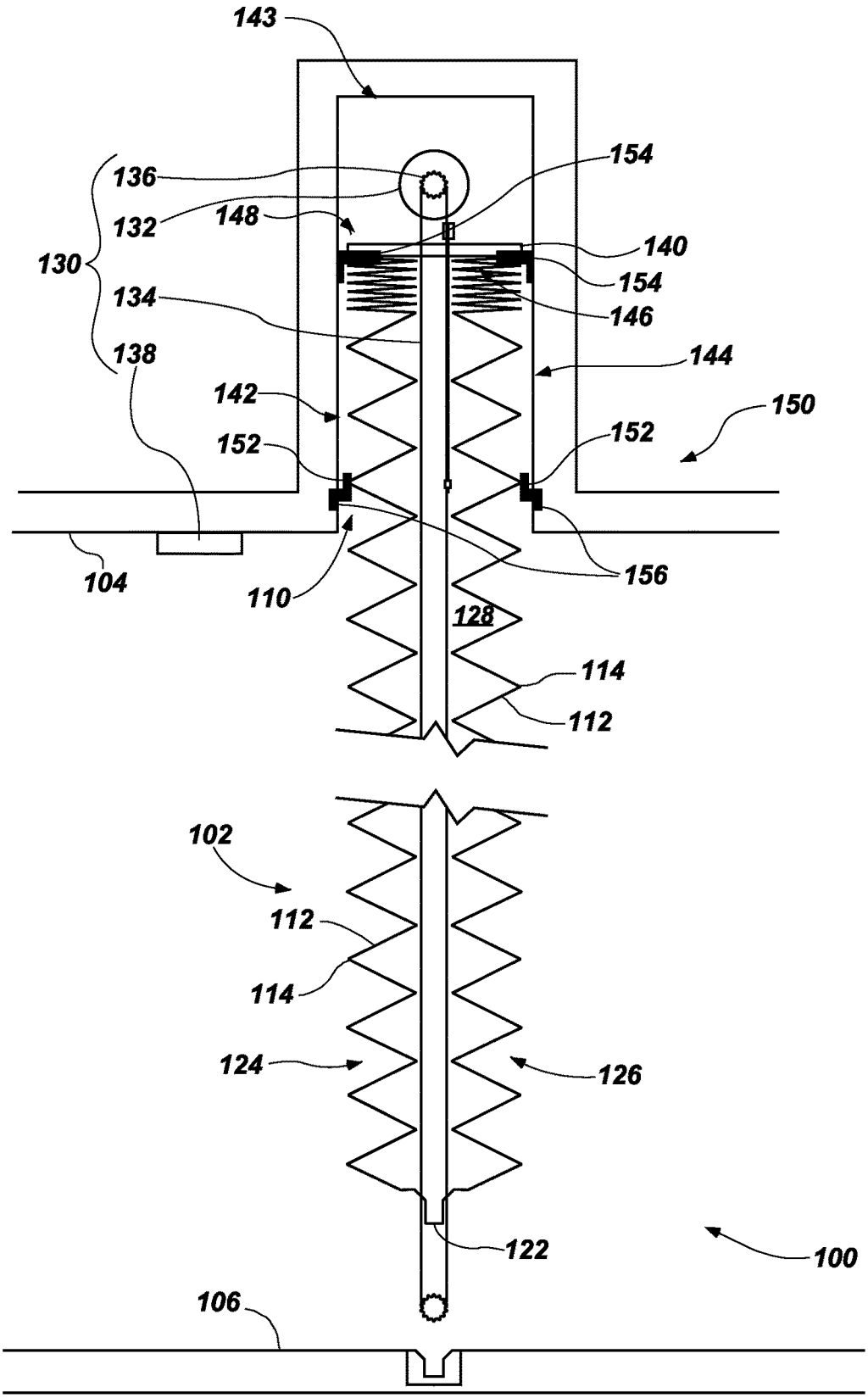
FIG. 2 is a simplified top view of a portion of the partition system of FIG. 1.

FIG. 2 is a simplified top view of a portion of the partition system 100 of FIG. 1. In some embodiments, such as that shown in FIG. 2, the partition 102 may include multiple sheets 124 and 126 of the interconnected panels 112 and hinges 114. For example, the partition 102 may include a first sheet 124 of the interconnected panels 112 and hinges 114 extending laterally from within the pocket 110 to the lead post 122 and a second sheet 126 spaced horizontally from, and extending at least substantially parallel to, the first sheet 124 from within the pocket 110 to the lead post 122. In other embodiments, the partition 102 may include the interconnected panels 112 having hinged couplings between pleated portions of a continuous sheet of material. The first and second sheets 124 and 126 may be connected to a floating jamb 140 within the pocket 110. The floating jamb 140 has a distal side 146 facing toward the leading end of the partition 102 and a proximal side 148 facing toward a rear wall 143 of the pocket 110 (e.g., facing away from the leading end of the partition 102). The floating jamb 140 may extend horizontally from a first sidewall 142 on a first side of the pocket 110 to a second sidewall 144 on an opposite side of the pocket 110 to form a barrier (e.g., a security barrier) between the subdivided portions of the space 108. The floating jamb 140 may be configured to slide laterally within the pocket 110 to accommodate extension and retraction of the partition 102 while maintaining a barrier between the subdivided portions of the space 108 beyond the sheets 124 and 126 of the partition 102. An interior space 128 may be located horizontally between the sheets 124 and 126 and between the lead post 122 and the floating jamb 140.

The partition system 100 may include a drive system 130 configured to drive automatic extension and retraction of the partition 102. The drive system 130 may include, for example, a motor 132 configured to mechanically power the movement of the partition 102, a continuous drive member 134 (e.g., a chain, belt) configured to transfer power from the motor 132 to the partition 102, a drive shaft 136 (e.g., a sprocket, gear, roller) operatively connecting the continuous drive member 134 to the motor 132 to transfer motive power from the motor 132 to the continuous drive member 134, and a control system 138 operatively connected to the motor 132 to control the activation, speed, power, and direction of the output of the motor 132. Such drive systems are described in detail, for example, in U.S. Pat. No. 8,443,866, issued May 21, 2013 and titled "Methods, Apparatus, and Systems for Movable Partitions" and in U.S. Pat. No. 9,309,710, issued Apr. 12, 2016 and titled "Automatic Drive Systems, Movable Partition Systems Including Such Automatic Drive Systems, and Related Methods," the disclosure of each of which is incorporated herein in its entirety by this reference. In particular, the control system 138 may be configured to automatically extend or retract the partition 102 upon the occurrence of a predetermined event, such as the actuation of an associated alarm (e.g., a fire alarm or a security alarm). In some embodiments, the control system 138 may be configured to override door opening mechanisms (e.g., onsite push buttons) in order to ensure that the partition 102 remains in a secured position when a security alarm has been activated (e.g., from a remote monitoring location). Further, the control system 138 may be configured to automatically secure (e.g., lock) at least one of the lead post 122 or the floating jamb 140 into secure positions.

The partition system 100 may include a security assembly 150 configured to secure the floating jamb 140 within the pocket 110 when the partition 102 is in an extended position. The security assembly 150 may include, for example, one or more (e.g., two or more) jamb stops 152 attached to an interior surface of the pocket 110 on opposing surfaces of each of the first sidewall 142 and the second sidewall 144, for example, toward a front end of the pocket 110. The security assembly 150 may also include one or more (e.g., two or more) base plates 154 attached to opposing sides of the floating jamb 140. Further, the base plates 154 may be supported on the floating jamb 140 using suitable hardware (e.g., nuts, bolts, washers, support plates, etc.). In addition, spacers 156 (e.g., shims) may be positioned between at least some of the jamb stops 152 and the sidewalls 142, 144 to ensure proper placement (e.g., lateral position) between the jamb stops 152 and the base plates 154 during installation of the partition systems 100 to accommodate differing sizes (e.g., widths) of the floating jamb 140 and/or the pocket 110.

Figure 3:
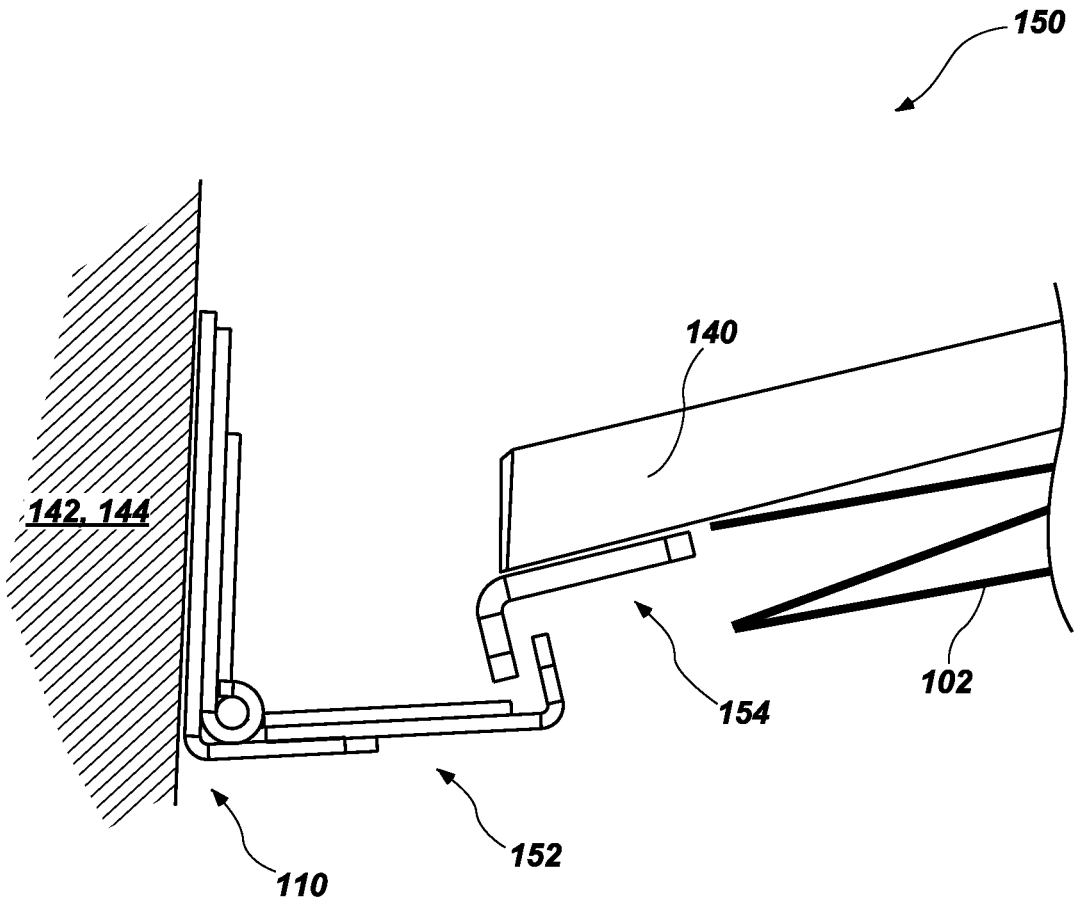
FIG. 3 is an enlarged view of a portion of a security assembly of the partition system of FIG. 2.

FIG. 3 is an enlarged view of a portion of the security assembly 150 shown in FIG. 2. As previously described above, the jamb stops 152 may be attached to opposing surfaces of the first sidewall 142 and the second sidewall 144 toward a front end of the pocket 110, and the base plates 154 may be attached to the floating jamb 140. The base plates 154 may be located and configured to cooperatively engage a respective jamb stop 152 during deployment of the partition 102 and to remain engaged as long as the partition 102 is in an extended (e.g., fully extended) position. In particular, each of the base plates 154 may be positioned and configured to cooperatively engage a respective jamb stop 152 in order to prevent the floating jamb 140 from exiting the pocket 110 during deployment of the partition 102. For example, an outer edge of the base plates 154 may extend laterally outward (e.g., beyond) an outer edge of the floating jamb 140. In such a configuration, the base plates 154 are located and configured to abut against the respective jamb stop 152. In some embodiments, the base plates 154 and the jamb stops 152 may be substantially "L-shaped" or "J-shaped," as discussed in greater detail below. As shown in FIG. 3, each of the base plates 154 and the jamb stops 152 are configured (e.g., sized and shaped) to closely align with opposing inner surfaces of one another in an interlocking connection, such that the floating jamb 140 provides a more effective fire barrier and/or security barrier. In particular, each of the base plates 154 and the jamb stops 152 are configured such that inner surfaces of each component are aligned substantially flush with one another when engaged. Further, the base plates 154 and/or the jamb stops 152 may include return corners (e.g., lips) at the end thereof to ensure secure engagement therebetween.

The jamb stops 152 and the base plates 154, as well as the floating jamb 140, may be of any material suitable for providing a fire barrier and/or a safety barrier able to withstand impact forces imposed during a security threat, for example. In particular, materials of the jamb stops 152 and/or the base plates 154 may include, for example, a metal material, such as steel. Further, the spacers 156 may be utilized to adjust spacing between the base plates 154 and the jamb stops 152 such that an inwardly extending lip of the base plates engages with an inwardly extending lip of a respective jamb stop 152. Thus, the jamb stops 152 and the base plates 154 may be configured (e.g., sized and shaped) to prevent displacement of the floating jamb 140 to deter (e.g., prevent) unauthorized access beyond the partition 102 when the partition 102 is in an extended position.

Further, the jamb stops 152 may be configured to be automatically releasable from the base plates 154 (e.g., resettable to an initial, unengaged position) when the partition 102 is deployed toward its retracted position for storage within the pocket 110. In some embodiments, at least one (e.g., both) of the jamb stops 152 may include a portion that is movable (e.g., hinged) relative to an adjacent stationary portion thereof in order to facilitate release and retraction of the components as the partition 102 is returned to the retracted position for storage within the pocket 110. In such an embodiment, one portion of the jamb stops 152 may be attached to the one of the first sidewall 142 or the second sidewall 144 such that the attached portion is stationary during operation, and an adjacent hinged portion of the jamb stops 152 may be configured to extend and retract during deployment and retraction of the partition 102. The base plates 154 may include two stationary portions that are not movable relative to one another, as shown in FIG. 3. Stated another way, a portion (e.g., an extended portion) of the jamb stops 152 may be configured to move (e.g., extend and retract) while each portion of the base plates 154 is configured to remain in a fixed position relative to one another. In other embodiments, one or more of the base plates 154 may be hinged, similar to that of the jamb stops 152, such that a portion (e.g., an extended portion) of the base plates 154 is configured to move while each portion of the jamb stops 152 is configured to remain in a fixed position relative to one another. In yet other embodiments, each of the jamb stops 152 and the base plates 154 may be configured to move (e.g., hinge) for ease of release when being returned to their respective initial positions. The jamb stops 152 are shown in greater detail in FIGS. 4A and 4B and the base plates 154 are shown in greater detail in FIGS. 5A and 5B.

Figure 4A:
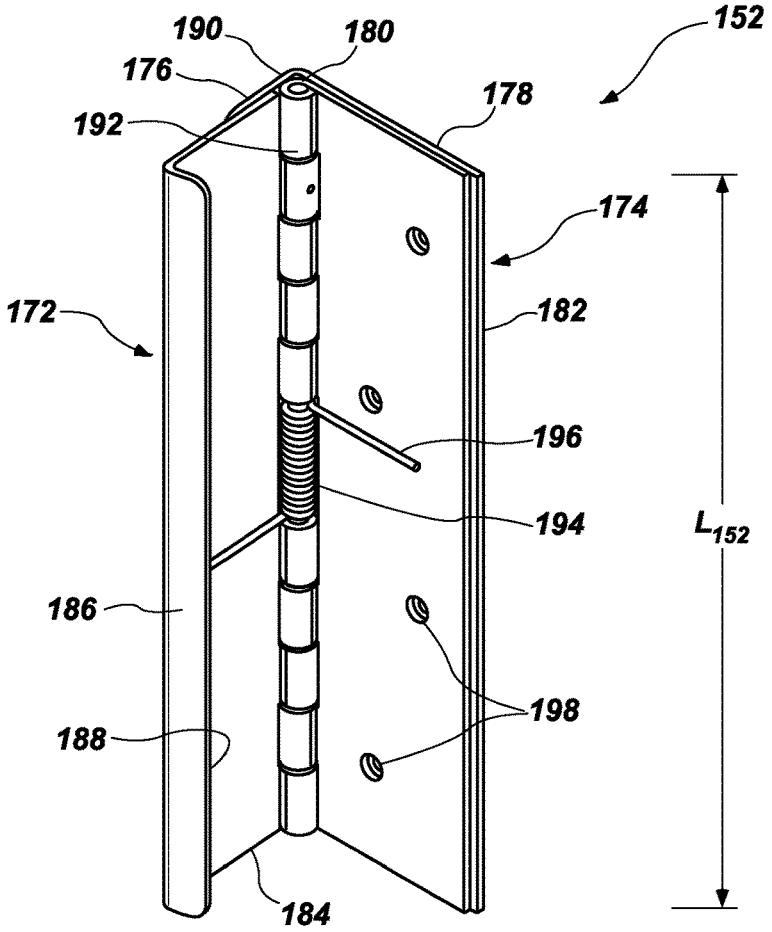
FIG. 4A is a perspective side view of a jamb stop of the security assembly of FIG. 3.

FIG. 4A is a perspective side view of one of the jamb stops 152. In some embodiments, the jamb stops 152 may be formed of one piece. In other embodiments, the jamb stops 152 may be formed of multiple (e.g., two or three) separate pieces that have been attached (e.g., bonded) to one another, as shown in the embodiment of FIG. 4A. For example, the jamb stops 152 may include an inner hinged portion 172 and an outer stationary portion 174 having a first segment 176, a second segment 178, and a corner 180 (e.g., a bend) therebetween. Thus, the outer stationary portion 174 is substantially "L-shaped." In some embodiments, one of the segments (e.g., the first segment 176) may extend less distance from the corner 180 than the other of the two segments (e.g., the second segment 178). The inner hinged portion 172 has a stationary base 182, a movable latch plate 184, and a corner 190 (e.g., a bend) therebetween. Further, the inner hinged portion 172 includes a hinge 192 (e.g., a piano hinge) at the corner 190 joining the stationary base 182 and the movable latch plate 184. In some embodiments, one of the portions (e.g., the movable latch plate 184) may extend less distance from the corner 190 than the other of the two portions (e.g., the stationary base 182). Further, the movable latch plate 184 includes a lip 186 (e.g., a return corner) having an inner surface 188. Thus, the inner hinged portion 172 is substantially "J-shaped" when in a fully extended position. The jamb stops 152 may also include a spring 194 (e.g., an 180° torsion spring) having opposing extension arms 196 extending therefrom. The spring 194 may be configured to retain the inner hinged portion 172 in the fully extended position absent sufficient compressive forces to depress the inner hinged portion 172 into a retracted position such that the stationary base 182 and the movable latch plate 184 are adjacent (e.g., substantially parallel) to one another. Further, each of the inner hinged portion 172 and the outer stationary portion 174 may include attachment points 198 (e.g., apertures) that are aligned with one another for use in attaching the jamb stops 152 to the sidewalls 142, 144 (FIG. 2).

Figure 4B:
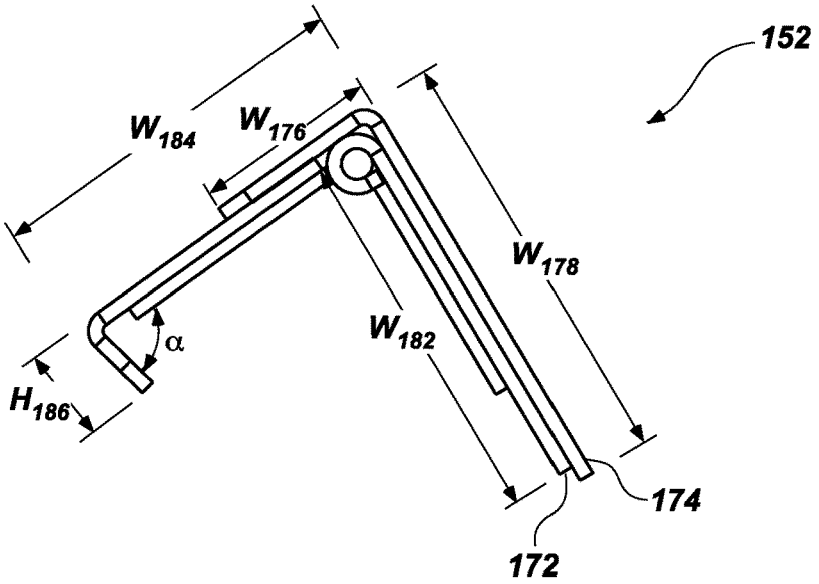
FIG. 4B is an end view of the jamb stop of FIG. 4A.

FIG. 4B is an end view of the jamb stop 152 shown in FIG. 4A. As best shown in FIG. 4B, the inner hinged portion 172 is adjacent to (e.g., nestled within) the outer stationary portion 174. The inner hinged portion 172 and the outer stationary portion 174 may be joined (e.g., adhered, welded, etc.) to affix the separately formed structures together. Further, when the inner hinged portion 172 is in the retracted position, the first segment 176 of the outer stationary portion 174 remains extended from (e.g., generally transverse to) the second segment 178 thereof. Each of the jamb stops 152 may be sized and shaped to facilitate engagement with the base plates 154 (FIG. 3). By way of example only, a length L152 of the jamb stop 152 (e.g., each of the inner hinged portion 172 and outer stationary portion 174) may be about 6.00 in. With regard to the outer stationary portion 174, a width W176 of the first segment 176 may be about 0.75 in, and a width W178 of the second segment 178 may be about 1.75 in. With regard to the inner hinged portion 172, a width W182 of the stationary base 182 may be about 1.50 in, a width W184 of the movable latch plate 184 may be about 1.29 in, and a height H186 of the lip 186 may be about 0.375 in. Further, an acute angle $\alpha$ between the movable latch plate 184 and the lip 186 may be between about 70° and about 90°, such as about 80°.

Figure 5A:
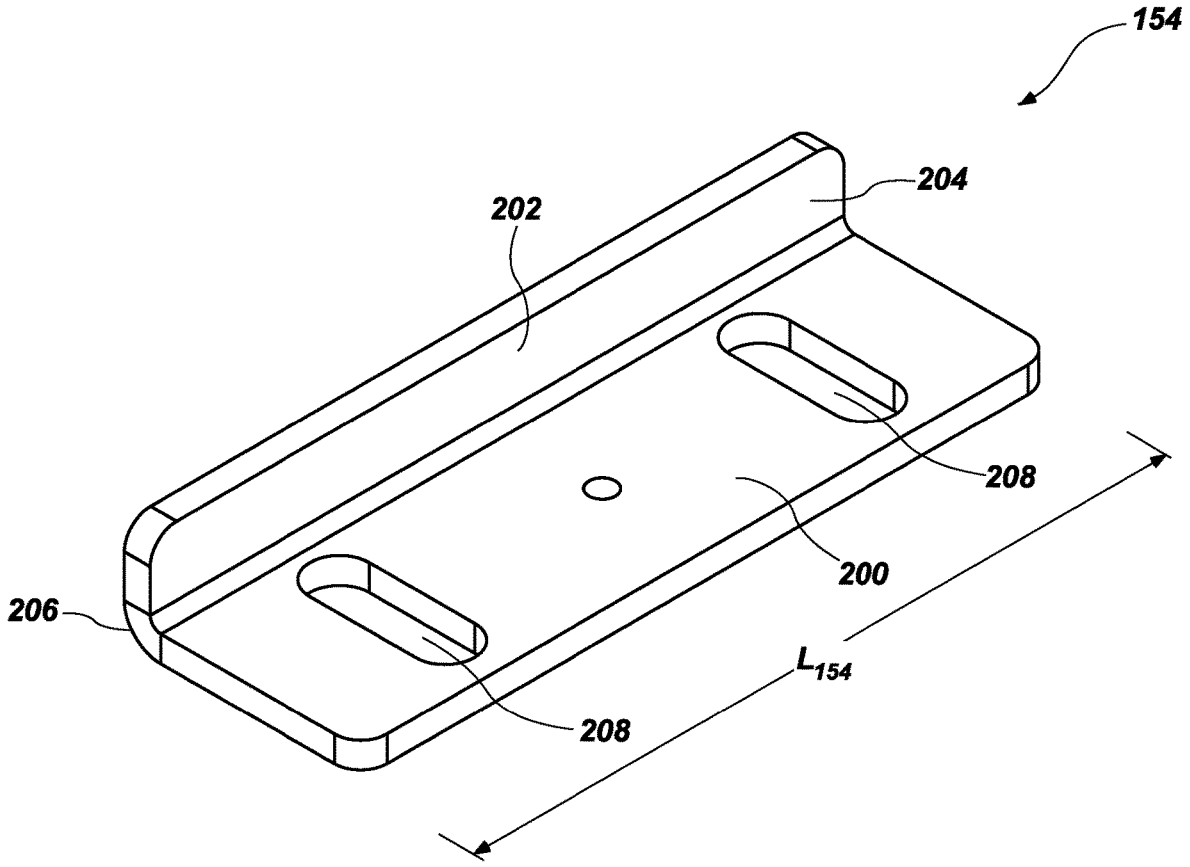
FIG. 5A is a perspective side view of a base plate of the security assembly of FIG. 3.
Figure 5B:
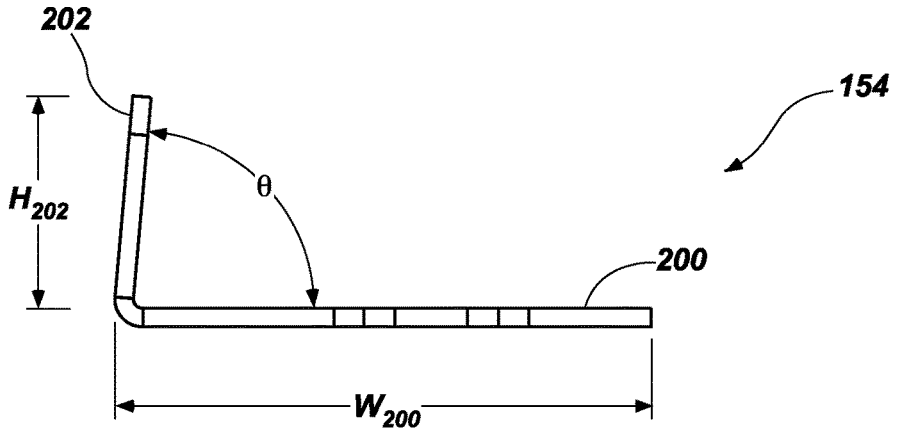
FIG. 5B is an end view of the base plate of FIG. 5A.

Referring now to FIG. 5A in combination with FIG. 5B, one of the base plates 154 of the security assembly 150 of FIG. 3 is shown in greater detail. FIG. 5A is a perspective side view of the base plate 154, and FIG. 5B is an end view of the base plate 154 of FIG. 5A. The base plates 154 may include, for example, a base portion 200, a lip 202, and a corner 206 therebetween. Thus, the base plates 154 are substantially "L-shaped" although, in some embodiments, the base portion 200 and the lip 202 may form an acute angle $\theta$, as shown in FIG. 5B. The lip 202 has an inner surface 204 configured to engage the inner surface 188 of the lip 186 of the jamb stops 152 when the jamb stops 152 and the base plates 154 are cooperatively engaged, as shown in FIG. 3. Thus, the acute angle θ of the base plates 154 may be similar (e.g., complementary) to the acute angle α of the jamb stops 152 (FIG. 4B). Further, the base plates 154 include elongated attachment points 208 (e.g., apertures) that may be oversized for ease of adjustment during installation in order to ensure proper alignment between the base plates 154 and the jamb stops 152. Each of the base plates 154 may be sized and shaped to facilitate engagement with the jamb stops 152. By way of example only, a length L154 of the base plates 154 may be about 3.30 in, a width $W_{200}$ of the base portion 200 may be about 1.125 in, and a height $H_{202}$ of the lip 202 may be about 0.50 in. Further, the acute angle θ may be between about 75° and about 90°, such as about 85°.

Although the disclosure describes and shows the jamb stops 152 including a movable (e.g., a hinged) portion, it is understood that the base plates 154 may additionally, or alternatively, include a hinged portion. Further, specific dimensions of the jamb stops 152, including the acute angle α of the lip 186, in combination with the dimensions of the base plates 154, including the acute angle θ of the lip 202, may be designed such that the safety barrier cannot be breached from only one side of the partition 102 in order to deter (e.g., prevent) displacement of the floating jamb 140 to prevent unauthorized access beyond the partition. Thus, use of the jamb stops 152 and the base plates 154 restricts the ability to shift the floating jamb 140 from one side to another side in order to bypass the jamb stops 152 and to gain unauthorized entry into a secure area.

Figure 6A:
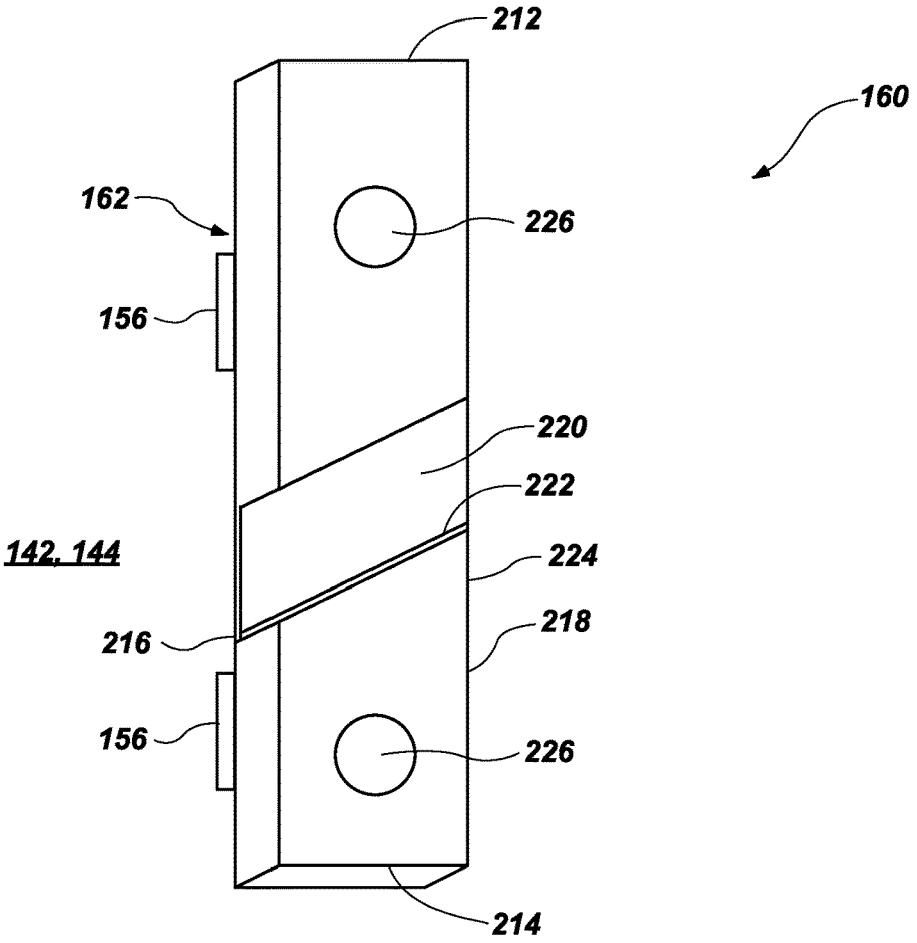
FIG. 6A is a perspective side view of an installation assembly including a support structure.
Figure 6B:
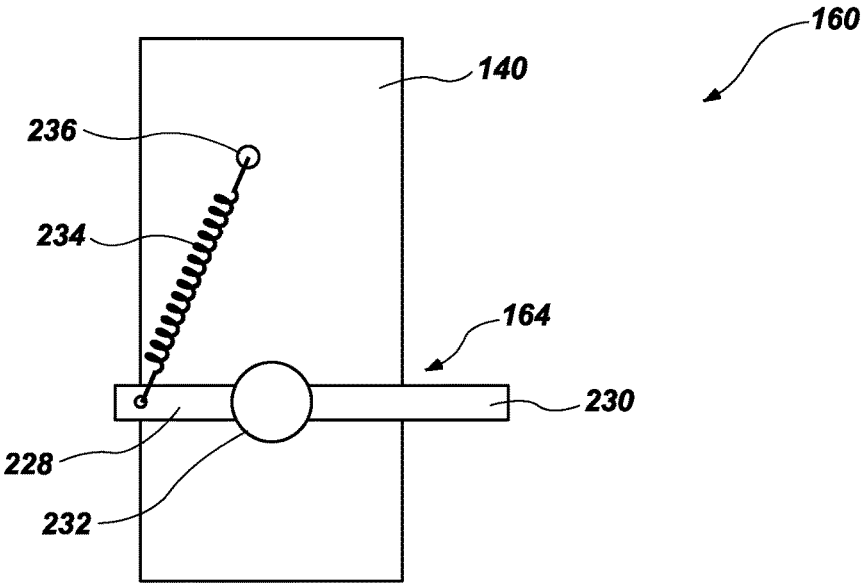
FIG. 6B is a perspective front view of a locking pin of the installation assembly of FIG. 6A.

Referring now to FIG. 6A in combination with FIG. 6B, an installation assembly 160 may provide additional or alternative security benefits to the security assembly 150 by securely retaining the floating jamb 140 within the pocket 110 (FIG. 2). The installation assembly 160 includes, for example, a support structure 162, shown in FIG. 6A, and a locking pin 164, shown in FIG. 6B. The support structure 162 may include, for example, a tubular member attached to an interior surface of the first sidewall 142 or the second sidewall 144. The locking pin 164 may be attached to the distal side 146, the proximal side 148, or an end surface, for example, of the floating jamb 140. The locking pin 164 may be inserted into an engaged position with the support structure 162 during installation and/or maintenance of the system and may be configured to remain in the engaged (e.g., locked) position throughout operation of the system. Further, the support structure 162 and locking pin 164 may be formed of durable materials, such as steel. Thus, the installation assembly 160 may be configured to provide additional security benefits to the security assembly 150.

Referring to FIG. 6A, the support structure 162 has a top 212, a bottom 214, a distal side 216 facing toward the leading end of the partition 102 (FIG. 2), and a proximal side 218 facing toward the rear wall 143 of the pocket 110. The support structure 162 may include, for example, a cavity 220 including a ramp portion 222 extending between the distal side 216 and the proximal side 218 of the support structure 162. In particular, the ramp portion 222 may be inclined as the edge thereof progresses from the distal side 216 to the proximal side 218 of the support structure 162, as shown in FIG. 6A. A rest stop 224 may be located on the proximal side 218 of the support structure 162 adjacent to (e.g., just below) a termination of the ramp portion 222. The rest stop 224 may be configured to retain the locking pin 164 in a locked position on the proximal side 218 of the support structure 162 until released by authorized personnel. Attachment points 226 may be provided on the support structure 162 and may include, for example, through holes on a front side of the tubular member of the support structure 162 and apertures on a back side thereof. The attachment points 226 may be configured to facilitate attachment of the support structure 162 to one of the sidewalls 142, 144 using suitable hardware (e.g., screws, bolts, rivets, etc.). Further, the spacers 156 may be provided behind the support structure 162 to ensure proper placement relative to the locking pin 164.

Referring to FIG. 6B, the locking pin 164 includes, for example, an extension portion 228 extending in one direction from a pivot point 232 and a locking portion 230 extending in another, opposite direction from the pivot point 232. The pivot point 232 may include an attachment point (e.g., a through hole) for attaching the locking pin 164 to the floating jamb 140 using suitable hardware (e.g., nuts, bolts, washers, rivets, etc.) that permits the locking pin to swivel about the pivot point 232. The locking pin 164 also includes a spring 234 positioned between the extension portion 228 and an attachment point 236 on the floating jamb 140. During installation of the installation assembly 160, the locking pin 164 may be positioned within the cavity 220 of the support structure 162. Upon applied pressure to the floating jamb 140, the locking pin 164 is guided by the ramp portion 222 toward the rest stop 224 on the proximal side 218 of the support structure 162 where it remains in a locked position until released using manual force, a tool, or an actuator, for example. The spring 234 is extended while the locking portion 230 of the locking pin 164 is guided by the ramp portion 222, and the spring 234 is then retracted to an initial position to bias the locking pin 164 within the rest stop 224. In some embodiments, more than one (e.g., two) of the support structures 162 and associated locking pins 164 may be attached to each of the first sidewall 142 and the second sidewall 144 to provide enhanced security. In other embodiments, additional or alternative components may be included in the installation assembly 160 including, for example, cable restraints attached to the rear wall 143 of the pocket 110 (FIG. 2) and to the floating jamb 140. Thus, the installation assembly 160 may provide additional security benefits to the security assembly 150 by securely retaining the floating jamb 140 within the pocket 110.

Figure 7:
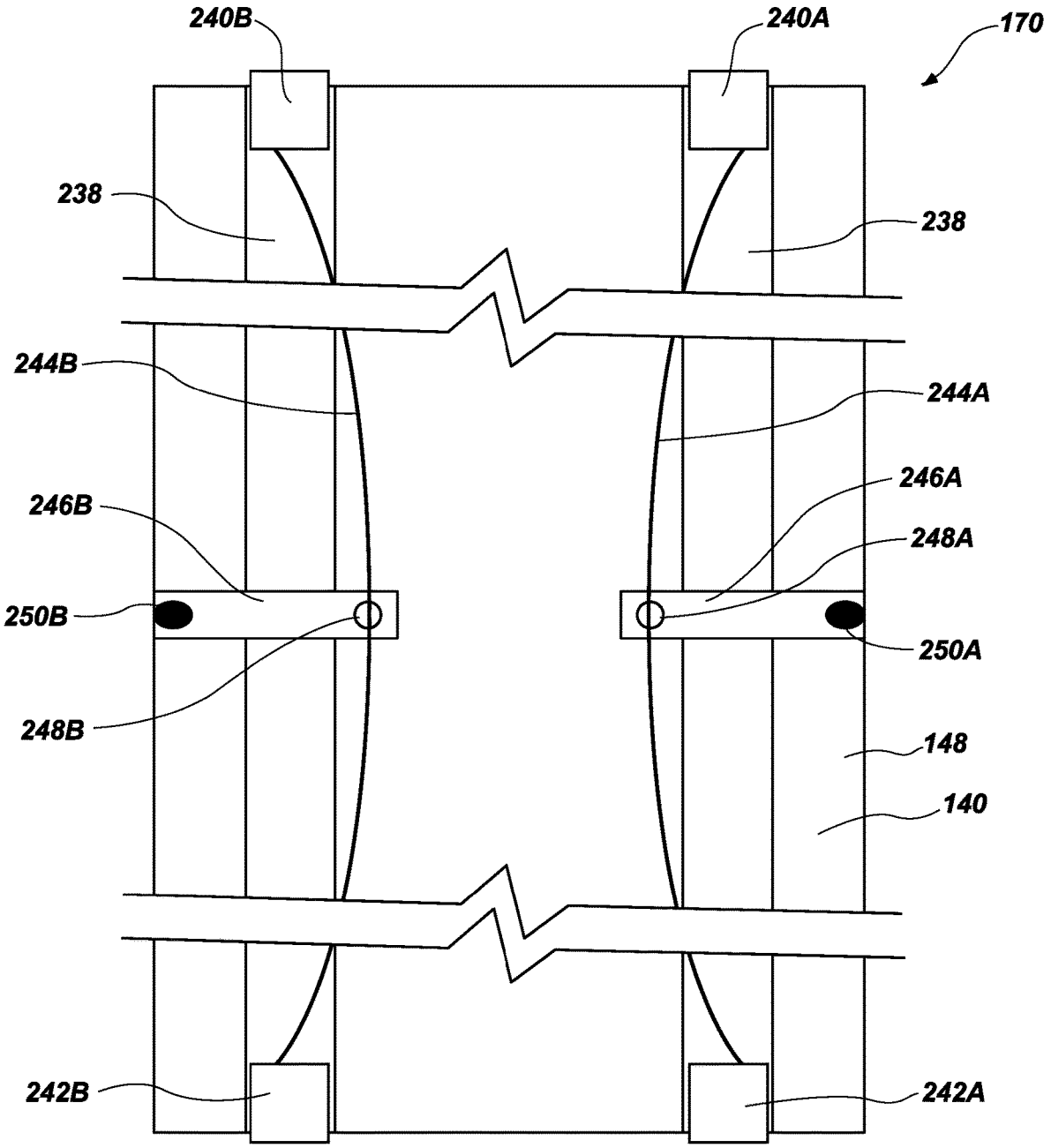
FIG. 7 is a simplified plan view of a locking panel assembly for a partition system.

FIG. 7 is a simplified plan view of a locking panel assembly 170. In some embodiments, the locking panel assembly 170 may be configured to provide enhanced security benefits to the security assembly 150 of FIG. 2. For example, the locking panel assembly 170 may include multiple (e.g., at least two) sets of locking mechanisms that are separately actuated (e.g., locked and unlocked) from each side of the partition 102 (FIG. 2), thus requiring access from both sides of the partition 102 when the partition 102 is in an extended position. Further, the locking panel assembly 170 may require specialized tools or security devices in order to gain adequate access to displace and/or gain access beyond the floating jamb 140.

The locking panel assembly 170 includes, for example, locking mechanisms 240A, 240B, 242A and 242B (e.g., locks) attached to the floating jamb 140 and configured to engage with stationary supports (not shown) that may be located within the pocket 110 (FIG. 2). In particular, the locking mechanisms 240A and 242A may be located adjacent a first lateral edge of the floating jamb 140 on the proximal side 148 thereof and may be operably connected to one another with a wire 244A. Similarly, the locking mechanisms 240B and 242B may be located adjacent a second lateral edge of the floating jamb 140 on the proximal side 148 thereof and may be operably connected to one another with a wire 244B. In some embodiments, the locking mechanisms 240A and 240B may be located proximate (e.g., at) a top of the floating jamb 140, and the locking mechanisms 242A and 242B may be located proximate (e.g., at) a bottom of the floating jamb 140. Although the disclosure describes and shows the locking panel assembly 170 being attached to the floating jamb 140, it is understood that the locking panel assembly 170 may, alternatively, be attached to any other surface or panel associated with the floating jamb 140.

The locking panel assembly may also include attachment plates 246A and 246B as attachment points for the wires 244A and 244B. The attachment plates 246A and 246B may include respective pivot points 248A and 248B located proximate (e.g., at) the respective lateral edges of the floating jamb 140. The pivot points 248A and 248B are attached to the floating jamb 140 using suitable hardware (e.g., nuts, bolts, washers, rivets, etc.) that permits each of the attachment plates 246A and 246B to swivel about the respective pivot points 248A and 248B. Actuators 250A and 250B may be associated with (e.g., coupled to) the respective attachment plates 246A and 246B. Further, the actuators 250A and 250B are configured to pivot the attachment plates 246A and 246B about the respective pivot points 248A and 248B in two separate directions (e.g., up and down). In some embodiments, at least some of the components of the locking panel assembly 170 may be positioned within indented portions 238 of the floating jamb 140 such that the components do not interfere with other components of the system that are associated with (e.g., attached to) the floating jamb 140.

In use, the actuators 250A and 250B are accessed and operated independent from one another. For example, the actuator 250A is accessed and operated from one side of the partition 102 (FIG. 2), while the actuator 250B is accessed and operated from the other side of the partition 102 when the partition 102 is in the extended position. Further, operation of each of the actuators 250A and 250B requires a two-step process, resulting in four individual steps to unlock the floating jamb 140 from a locked position. In some embodiments, as the actuator 250A is activated in a first direction, the locking mechanism 240A is released (e.g., unlocked) and as the actuator 250A is activated in a second direction, the locking mechanism 242A is released. Similarly, as the actuator 250B is activated in a first direction, the locking mechanism 240B is released, and as the actuator 250B is activated in a second direction, the locking mechanism 242B is released. For example, if the actuator 250A requires a key for activation, the key may be first turned clockwise then counterclockwise to release the locking mechanisms 240A and 242A. In particular, activation of the actuators 250A and 250B results in each of the attachment plates 246A and 246B being turned, independent of one another, in the first direction and the second direction. Thus, each activation step results in tension being applied to each of the wires 244A and 244B, respectively, in a first vertical direction (e.g., down) and then in a second vertical direction (e.g., up) enabling release of each of the locking mechanisms 240A, 240B, 242A, and 242B, in a total of four individual steps.

In some embodiments, the actuators 250A and 250B may be activated by hand. In other embodiments, the actuators 250A and 250B may be activated by a common tool (e.g., screwdriver, wrench, etc.) or a specialized tool that has been designed for this purpose. In yet other embodiments, the actuators 250A and 250B may be activated by a security device including, for example, a key, a coded touch pad, an electromagnetic card, etc. Thus, security may be enhanced by using the locking panel assembly 170 of the security assembly 150. Requiring a two-step activation process on each side of the partition 102 (FIG. 2) further ensures that the safety barrier cannot be breached from only one side of the partition 102 when the partition 102 is in an extended (e.g., locked) position.

In summary, movable partition systems including a floating jamb secured within the pocket when the movable partition is in an extended position in accordance with this disclosure may enable security measures (e.g., security barriers) not previously practiced in the art, such as, for example, preventing displacement of the floating jambs when the partitions have been deployed to deter (e.g., prevent) unauthorized access beyond the partition. Such security measures may be enhanced by using interlocking jamb stops and base plates, as well as by using installation assemblies and/or locking panel assemblies to enhance secure placement of the floating jambs within the pockets. Numerous advantages are achieved by using movable partition systems including such security measures described above. For example, such movable partition systems including floating jambs secured within a pocket when the movable partitions are in an extended position may be utilized to secure buildings and/or designated areas upon detection of a security threat, such as, for example, assault by an armed aggressor, while ensuring that the security barriers cannot be breached from only one side of the barrier.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed:

1. A movable partition system, comprising:

a movable partition;

a floating jamb attached to an end of the movable partition and located within a pocket configured to retain the movable partition when in a retracted position;

at least two base plates attached to the floating jamb; and at least two jamb stops attached to opposing interior walls of the pocket, each of the at least two jamb stops configured to engage a respective base plate of the floating jamb, wherein the floating jamb, the at least two base plates, and the at least two jamb stops are configured such that displacement of the floating jamb is prevented when accessed through only one side of the movable partition when the movable partition is in an extended position, and such that disengaging the floating jamb from a secure position within the pocket when the movable partition is in the extended position requires accessing one of the at least two jamb stops from a first side of the movable partition to disengage the respective base plate on a first side of the floating jamb from the one of the at least two jamb stops and accessing another one of the at least two jamb stops from a second, opposing side of the movable partition to disengage the respective base plate on a second, opposing side of the floating jamb from the other one of the at least two jamb stops.

2. The movable partition system of claim 1, wherein:

the at least two base plates comprise two stationary plates extending from opposing sides of the floating jamb, each of the at least two base plates comprising an inwardly extending lip on an outer edge thereof; and each of the at least two jamb stops comprises an inwardly extending lip on an outer edge thereof.

3. The movable partition system of claim 2, further comprising spacer members located between at least some of the at least two jamb stops and one of the opposing interior walls of the pocket, the spacer members being utilized to adjust spacing between the at least two jamb stops and the at least two base plates such that the inwardly extending lip of each of the at least two jamb stops engages with the inwardly extending lip of the respective base plate.

4. The movable partition system of claim 1, wherein each of the at least two jamb stops comprises a stationary portion attached to one of the opposing interior walls of the pocket and a movable latch plate attached to the stationary portion with a hinge, the movable latch plate configured to extend and retract relative to the stationary portion during operation of the movable partition.

5. The movable partition system of claim 1, wherein each of the at least two base plates comprises a first retractable hinged member including a first lip and each of the at least two jamb stops comprises a second retractable hinged member including a second lip, the first lip of the first retractable hinged member of each of the at least two base plates configured to engage the second lip of the second retractable hinged member of a respective jamb stop when the movable partition is in the extended position.

6. The movable partition system of claim 1, further comprising a locking panel assembly comprising a plurality of locking mechanisms, wherein the locking panel assembly is configured to secure the floating jamb within the pocket such that displacement of the floating jamb within the pocket requires activation of the plurality of locking mechanisms using a security device.

7. The movable partition system of claim 6, wherein the plurality of locking mechanisms comprises a first upper locking mechanism and a second upper locking mechanism located at a top of the floating jamb and a first lower locking mechanism and a second lower locking mechanism located at a bottom of the floating jamb.

8. The movable partition system of claim 7, wherein the locking panel assembly comprises:

a first actuator configured to activate the first upper locking mechanism and the first lower locking mechanism using a first wire extending therebetween; and a second actuator configured to activate the second upper locking mechanism and the second lower locking mechanism using a second wire extending therebetween.

9. A movable partition system, comprising:

a movable partition having a distal end and a proximal end;

a lead post attached to the distal end of the movable partition;

a floating jamb attached to the proximal end of the movable partition, the floating jamb configured to glide within a pocket during extension and retraction of the movable partition; and a security assembly comprising:

at least two opposing base plates attached to the floating jamb, each of the at least two opposing base plates comprising a base portion and a lip; and at least two opposing jamb stops attached to sidewalls of the pocket, each of the at least two opposing jamb stops comprising a hinged portion including a lip, wherein the lip of the hinged portion of the at least two opposing jamb stops is configured to engage the lip of a respective base plate when the movable partition is in an extended position, and wherein the floating jamb, the at least two opposing base plates, and the at least two opposing jamb stops are configured such that displacement of the floating jamb is prevented when accessed through only one side of the movable partition when the movable partition is in the extended position.

10. The movable partition system of claim 9, further comprising a control system configured to extend the movable partition and to lock the lead post into a secure position upon occurrence of a predetermined event.

11. The movable partition system of claim 9, wherein at least one of the at least two opposing jamb stops comprises an L-shaped support structure external to the hinged portion thereof, an extended portion of the L-shaped support structure being configured to extend beyond a profile of the hinged portion when the hinged portion is in a retracted position.

12. The movable partition system of claim 9, wherein:

the hinged portion of the at least two opposing jamb stops comprises a stationary base portion and a movable latch plate attached thereto, the lip of the hinged portion of the at least two opposing jamb stops extending from and forming an acute angle with the movable latch plate of the hinged portion; and the lip of the at least two opposing base plates forms an acute angle with the base portion thereof, the acute angle of the lip of the at least two opposing base plates being complementary to the acute angle of the lip of the hinged portion of the at least two opposing jamb stops.

13. The movable partition system of claim 9, wherein each of the at least two opposing base plates and the at least two opposing jamb stops comprises a spring-actuated hinged portion such that respective lips of the at least two opposing base plates and the at least two opposing jamb stops are configured to engage with one another when the movable partition is in the extended position and to automatically disengage from one another when the movable partition moves toward a retracted position.

14. The movable partition system of claim 9, further comprising an installation locking mechanism located within the pocket, wherein the installation locking mechanism comprises a tubular support structure attached to an interior wall of the pocket and a locking pin attached to the floating jamb, the locking pin configured to be secured behind the tubular support structure during operation of the movable partition.

15. A method of providing a security barrier, comprising:

extending a movable partition of a movable partition system along at least one track with which the movable partition is engaged;

securing a lead post attached to a distal end of the movable partition to a receptacle of a post, an opposing wall, or another lead post of another movable partition; and securing a floating jamb attached to a proximal end of the movable partition, the floating jamb located within a pocket configured to retain the movable partition when in a retracted position;

wherein securing the floating jamb comprises engaging at least one first jamb stop attached to a to an interior sidewall of the pocket with at least one first base plate attached to the floating jamb and engaging at least one second jamb stop attached to an opposing interior sidewall of the pocket with at least one second base plate attached to an opposing side of the floating jamb; and wherein the floating jamb, the at least one first base plate, the at least one second base plate, the at least one first jamb stop, and the at least one second jamb stop are configured such that displacement of the floating jamb is prevented when accessed through only one side of the movable partition when the movable partition is in an extended position, and such that disengaging the floating jamb from a secure position within the pocket when the movable partition is in the extended position requires accessing the at least one first jamb stop from a first side of the movable partition to disengage the at least one first base plate on a first side of the floating jamb from the at least one first jamb stop and accessing the at least one second jamb stop from a second, opposing side of the movable partition to disengage the at least one second base plate on a second, opposing side of the floating jamb from the at least one second jamb stop.

16. The method of claim 15, wherein securing the floating jamb within the pocket comprises engaging a hinged portion of the at least one first jamb stop with a stationary portion of the at least one first base plate and engaging another hinged portion of the at least one second jamb stop with another stationary portion of the at least one second base plate.

17. The method of claim 15, wherein securing the floating jamb within the pocket further comprises restraining the floating jamb entirely within the pocket by engaging a pin attached to the floating jamb with a tubular support member attached to an interior wall of the pocket.

18. The method of claim 15, wherein securing the floating jamb within the pocket comprises locking the floating jamb within the pocket using locking mechanisms requiring use of a security device to disable the locking mechanisms in a two-step process from the first side of the movable partition and in another two-step process from the second, opposing side of the movable partition when the movable partition is in the extended position.

19. The method of claim 18, wherein securing the floating jamb within the pocket using the locking mechanisms comprises activating a first actuation device accessed from the first side of the movable partition and activating a second actuation device accessed from the second, opposing side of the movable partition such that the first actuation device is activated separately from the second actuation device.

20. The method of claim 15, further comprising automatically resetting each of the at least one first jamb stop and the at least one second jamb stop to an initial position as the movable partition moves to a fully retracted position within the pocket.

* * * * *